US010032461B2

(12) United States Patent
Srinivasan

(10) Patent No.: US 10,032,461 B2
(45) Date of Patent: Jul. 24, 2018

(54) METHOD AND APPARATUS FOR GENERATING A SPEECH SIGNAL

(71) Applicant: KONINKLIJKE PHILIPS N.V., Eindhoven (NL)

(72) Inventor: Sriram Srinivasan, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/766,567

(22) PCT Filed: Feb. 18, 2014

(86) PCT No.: PCT/IB2014/059057

§ 371 (c)(1),
(2) Date: Aug. 7, 2015

(87) PCT Pub. No.: WO2014/132167

PCT Pub. Date: Sep. 4, 2014

(65) Prior Publication Data

US 2015/0380010 A1 Dec. 31, 2015

Related U.S. Application Data

(60) Provisional application No. 61/769,236, filed on Feb. 26, 2013.

(51) Int. Cl.
*G10L 21/00* (2013.01)
*G10L 21/0208* (2013.01)
(Continued)

(52) U.S. Cl.
CPC ..... *G10L 21/0208* (2013.01); *G10L 25/51* (2013.01); *H04R 1/025* (2013.01);
(Continued)

(58) Field of Classification Search
CPC ..... G10L 17/06; G10L 19/00
(Continued)

(56) References Cited

U.S. PATENT DOCUMENTS 3,814,856 A 6/1974 Dugan
5,638,487 A * 6/1997 Chigier ..... G10L 15/04 704/202

(Continued)

FOREIGN PATENT DOCUMENTS

EP 0682436 A2 11/1995
WO 2006078003 A2 7/2006

(Continued)

OTHER PUBLICATIONS

Srinivasan et al, "Codebook Driven Short-Term Predictor Parameter Estimation for Speech Enhancement" IEEE Transactions on Audio, Speech, and Language Processing, vol. 14, No. 1, Jan. 2006.

(Continued)

*Primary Examiner* — Michael Colucci

(57) ABSTRACT

An apparatus includes microphone receivers configured to receive microphone signals from a plurality of microphones. A comparator configured to determine a speech similarity indication indicative of a similarity between the microphone signal and non-reverberant speech for each microphone signal. The determination is in response to a comparison of a property derived from the microphone signal to a reference property for non-reverberant speech. In some embodiments, the comparator is configured to determine the similarity indication by comparing to reference properties for speech samples of a set of non-reverberant speech samples. A generator is configured to generate a speech signal by combining the microphone signals in response to the similarity indications. The apparatus may be distributed over a plurality of devices each containing a microphone, and the (Continued)

approach may determine the most suited microphone for generating the speech signal.

15 Claims, 4 Drawing Sheets

(51) Int. Cl.
*H04R 1/40* (2006.01)
*H04R 1/02* (2006.01)
*H04R 3/00* (2006.01)
*G10L 25/51* (2013.01)
*G10L 21/0216* (2013.01)

(52) U.S. Cl.
CPC ..... *H04R 1/406* (2013.01); *H04R 3/005* (2013.01); *G10L 2021/02082* (2013.01); *G10L 2021/02161* (2013.01); *H04R 2201/023* (2013.01); *H04R 2420/07* (2013.01)

(58) Field of Classification Search
USPC ..... 704/500, 203, 235, 230
See application file for complete search history.

(56) References Cited

U.S. PATENT DOCUMENTS 6,243,322 B1 * 6/2001 Zakarauskas ..... G01S 11/14 367/124
6,684,185 B1 * 1/2004 Junqua ..... G10L 15/26 704/243
7,130,797 B2 * 10/2006 Beaucoup ..... G01S 3/8083 704/215
7,761,291 B2 * 7/2010 Renevey ..... G10L 21/0272 381/23.1
8,340,975 B1 * 12/2012 Rosenberger ..... G10L 15/22 704/270
8,660,281 B2 * 2/2014 Bouchard ..... G10L 21/0208 381/23.1
8,731,911 B2 * 5/2014 Chen ..... G10L 25/69 704/205
9,058,806 B2 * 6/2015 Sankar ..... G10L 17/02
9,258,429 B2 * 2/2016 Bruhn ..... H04M 3/569
2002/0106092 A1 8/2002 Matsuo
2005/0114141 A1 * 5/2005 Grody ..... G10L 15/30 704/270
2007/0160240 A1 7/2007 Ito et al.
2009/0190769 A1 7/2009 Wang
2009/0304187 A1 12/2009 Dittberner
2010/0208904 A1 8/2010 Nakajima et al.
2010/0278358 A1 11/2010 Pocino et al.
2011/0038486 A1 2/2011 Beaucoup
2011/0099019 A1 * 4/2011 Zopf ..... G10L 19/16 704/500
2014/0170979 A1 * 6/2014 Samanta Singhar ... G10L 25/60 455/41.2
2014/0379332 A1 * 12/2014 Rodriguez ..... G10L 17/00 704/219

FOREIGN PATENT DOCUMENTS

WO 2008092138 A1 7/2008
WO 2012099518 A1 7/2012

OTHER PUBLICATIONS

Griebel, "A Microphone Array System for Speech Source Localization, Denoising, and Dereverberation", Thesis, Harvard Universiy, Apr. 2002, 163 Page Document.
Habets, "Single-and Multi-Microphone Speech Dereverberation Using Spectral Enhancement", 2007, 257 Page Document.
Linde et al, "An Algorithm for Vector Quantizer Design", IEEE Transactions on Communications, vol. COM-28, No. 1, Jan. 1980, pp. 84-95.

* cited by examiner

METHOD AND APPARATUS FOR GENERATING A SPEECH SIGNAL

CROSS-REFERENCE TO PRIOR APPLICATIONS

This application is the U.S. National Phase application under 35 U.S.C. § 371 of International Application No. PCT/IB2014/059057, filed on Feb. 18, 2014, which claims the benefit of U.S. Provisional Application 61/769,236 filed on Feb. 26, 2013. These applications are hereby incorporated by reference herein.

FIELD OF THE INVENTION

The invention relates to a method and apparatus for generating a speech signal, and in particular to generating a speech signal from a plurality of microphone signals, such as e.g. microphones in different devices.

BACKGROUND OF THE INVENTION

Traditionally, speech communication between remote users has been provided through a direct two way communication using dedicated devices at each end. Specifically, traditional communication between two users has been via a wired telephone connection or a wireless radio connection between two radio transceivers. However, in the last decades, the variety and possibilities for capturing and communicating speech has increased substantially and a number of new services and speech applications have been developed, including more flexible speech communication applications.

For example, the widespread acceptance of broadband Internet connectivity has led to new ways of communication. Internet telephony has significantly lowered the cost of communication. This, combined with the trend of families and friends to be spread around the globe, has resulted in phone conversations lasting for long durations. VoIP (Voice over Internet Protocol) calls lasting for longer than an hour are not uncommon, and user comfort during such long calls is now more important than ever.

In addition, the range of devices owned and used by a user has increased substantially. Specifically, devices equipped with audio capture and typically wireless transmission are becoming increasingly common, such as e.g., mobile phones, tablet computers, notebooks, etc.

The quality of most speech applications is highly dependent on the quality of the captured speech. Accordingly, most practical applications are based on positioning a microphone close to the mouth of the speaker. For example, mobile phones include a microphone which when in use is positioned close the user's mouth by the user. However, such an approach may be impractical in many scenarios and may provide a user experience which is less than optimal. For example, it may be impractical for a user to have to hold a tablet computer close to the head.

In order to provide a freer and more flexible user experience, various hands free solutions have been proposed. These include wireless microphones which are comprised in very small enclosures that may be worn and e.g. attached to the user's clothes. However, this is still perceived to be inconvenient in many scenarios. Indeed, enabling hands-free communication with the freedom to move and multi-task during a call, but without having to be close to a device or to wear a headset, is an important step towards improved user experience.

Another approach is to use hands free communication based on a microphone being positioned further away from the user. For example, conference systems have been developed which when positioned e.g. on a table will pick-up speakers located around the room. However, such systems tend to not always provide optimum speech quality, and in particular the speech from more distant users tends to be weak and noisy. Also, the captured speech will in such scenarios tend to have a high degree of reverberation which may reduce the intelligibility of the speech substantially.

It has been proposed to use more than one microphone for e.g. such teleconferencing systems. However, a problem in such cases is that of how to combine the plurality of microphone signals. A conventional approach is to simply sum the signals together. However, this tends to provide suboptimal speech quality. Various more complex approaches have been proposed, such as performing a weighted summation based on the relative signal levels of the microphone signals. However, the approaches tend to provide suboptimal performance in many scenarios, such as e.g. still including a high degree of reverberation, being sensitive to absolute levels, being complex, requiring centralized access to all microphone signals, being relatively impractical, requiring dedicated devices etc.

Hence, an improved approach for capturing speech signals would be advantageous and in particular an approach allowing increased flexibility, improved speech quality, reduced reverberation, reduced complexity, reduced communication requirements, increased adaptability for different devices (including multifunction devices), reduced resource demand and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided an apparatus for generating a speech signal, the apparatus comprising: microphone receivers for receiving microphone signals from a plurality of microphones; a comparator arranged to, for each microphone signal, determine a speech similarity indication indicative of a similarity between the microphone signal and non-reverberant speech, the comparator being arranged to determine the similarity indication in response to a comparison of at least one property derived from the microphone signal to at least one reference property for non-reverberant speech; and a generator for generating the speech signal by combining the microphone signals in response to the similarity indications.

The invention may allow an improved speech signal to be generated in many embodiments. In particular, it may in many embodiments allow a speech signal to be generated with less reverberation and/or often less noise. The approach may allow improved performance of speech applications, and may in particular in many scenarios and embodiments provide improved speech communication.

The comparison of at least one property derived from the microphone signals to a reference property for non-reverberant speech provides a particular efficient and accurate way of identifying the relative importance of the individual microphone signals to the speech signal, and may in particular provide a better evaluation than approaches based on e.g. signal level or signal-to-noise ratio measures. Indeed, the correspondence of the captured audio to non-reverberant speech signals may provide a strong indication of how much of the speech reaches the microphone via a direct path and how much reaches the microphone via reverberant paths.

The at least one reference property may be one or more properties/values which are associated with non-reverberant speech. In some embodiments, the at least one reference property may be a set of properties corresponding to different samples of non-reverberant speech. The similarity indication may be determined to reflect a difference between the value of the at least one property derived from the microphone signal and the at least one reference property for non-reverberant speech, and specifically to at least one reference property of one non-reverberant speech sample. In some embodiments the at least one property derived from the microphone signal may be the microphone signal itself. In some embodiments the at least one reference property for non-reverberant speech may be a non-reverberant speech signal. Alternatively, the property may be an appropriate feature such as gain normalized spectral envelopes.

The microphones providing the microphone signals may in many embodiments be microphones distributed in an area, and may be remote from each other. The approach may in particular provide improved usage of audio captured at different positions without requiring these positions to be known or assumed by the user or the apparatus/system. For example, the microphones may be randomly distributed in an ad-hoc fashion around a room, and the system may automatically adapt to provide an improved speech signal for the specific arrangement.

The non-reverberant speech samples may specifically be substantially dry or anechoic speech samples.

The speech similarity indication may be any indication of a degree of difference or similarity between the individual microphone signal (or part thereof) and non-reverberant speech, such as e.g. a non-reverberant speech sample. The similarity indication may be a perceptual similarity indication.

In accordance with an optional feature of the invention, the apparatus comprises a plurality of separate devices, each device comprising a microphone receiver for receiving at least one microphone signal of the plurality of microphone signals.

This may provide a particularly efficient approach for generating a speech signal. In many embodiments, each device may comprise the microphone providing the microphone signal. The invention may allow improved and/or new user experiences with improved performance.

For example, a number of possible diverse devices may be positioned around a room. When executing a speech application, such as a speech communication, the individual devices may each provide a microphone signal, and these may be evaluated to find the most suited devices/microphones to use for generating the speech signal.

In accordance with an optional feature of the invention, at least a first device of the plurality of separate devices comprises a local comparator for determining a first speech similarity indication for the at least one microphone signal of the first device.

This may provide an improved operation in many scenarios, and may in particular allow a distributed processing which may reduce e.g. communication resources and/or spread computational resource demands.

Specifically, in many embodiments, the separate devices may determine a similarity indication locally and may only transmit the microphone signal if the similarity criterion meets a criterion.

In accordance with an optional feature of the invention, the generator is implemented in a generator device separate from at least the first device; and wherein the first device comprises a transmitter for transmitting the first speech similarity indication to the generator device.

This may allow advantageous implementation and operation in many embodiments. In particular, it may in many embodiments allow one device to evaluate the speech quality at all other devices without requiring communication of any audio or speech signals. The transmitter may be arranged to transmit the first speech similarity indication via a wireless communication link, such as a Bluetooth™ or Wi-Fi communication link.

In accordance with an optional feature of the invention, the generator device is arranged to receive speech similarity indications from each of the plurality of separate devices, and wherein the generator is arranged to generate the speech signal using a subset of microphone signals from the plurality of separate devices, the subset being determined in response to the speech similarity indications received from the plurality of separate devices.

This may allow a highly efficient system in many scenarios where a speech signal can be generated from microphone signals being picked up by different devices, with only the best subset of devices being used to generate the speech signal. Thus, communication resources are reduced substantially, typically without significant impact on the resulting speech signal quality.

In many embodiments, the subset may include only a single microphone. In some embodiments, the generator may be arranged to generate the speech signal from a single microphone signal selected from the plurality of microphone signals based on the similarity indications.

In accordance with an optional feature of the invention, at least one device of the plurality of separate devices is arranged to transmit the at least one microphone signal of the at least one device to the generator device only if the at least one microphone signal of the at least one device is comprised in the subset of microphone signals.

This may reduce communication resource usage, and may reduce computational resource usage for devices for which the microphone signal is not included in the subset. The transmitter may be arranged to transmit the at least one microphone signal via a wireless communication link, such as a Bluetooth™ or Wi-Fi communication link.

In accordance with an optional feature of the invention, the generator device comprises a selector arranged to determine the subset of microphone signals, and a transmitter for transmitting an indication of the subset to at least one of the plurality of separate devices.

This may provide advantageous operation in many scenarios.

In some embodiments, the generator may determine the subset and may be arranged to transmit an indication of the subset to at least one device of the plurality of devices. For example, for the device or devices of microphone signals comprised in the subset, the generator may transmit an indication that the device should transmit the microphone signal to the generator.

The transmitter may be arranged to transmit the indication via a wireless communication link, such as a Bluetooth™ or Wi-Fi communication link.

In accordance with an optional feature of the invention, the comparator is arranged to determine the similarity indication for a first microphone signal in response to a comparison of at least one property derived from the microphone signal to reference properties for speech samples of a set of non-reverberant speech samples.

The comparison of microphone signals to a large set of non-reverberating speech samples (e.g. in an appropriate feature domain) provides a particular efficient and accurate way of identifying the relative importance of the individual microphone signals to the speech signal, and may in particular provide a better evaluation than approaches based on e.g. signal level or signal-to-noise ratio measures. Indeed, the correspondence of the captured audio to non-reverberant speech signals may provide a strong indication of how much of the speech reaches the microphone via a direct path and how much reaches the microphone via reverberant/reflected paths. Indeed, it may be considered that the comparison to the non-reverberant speech samples includes a consideration of the shape of impulse response of the acoustic paths rather than just an energy or level consideration.

The approach may be speaker independent and in some embodiments the set of non-reverberant speech samples may include samples corresponding to different speaker characteristics (such as a high or low voice). In many embodiments, the processing may be segmented, and the set of non-reverberant speech samples may for example comprise samples corresponding to the phonemes of human speech The comparator may for each microphone signal determine an individual similarity indication for each speech sample of the set of non-reverberant speech samples. The similarity indication for the microphone signal may then be determined from the individual similarity indications, e.g. by selecting the individual similarity indication which is indicative of the highest degree of similarity. In many scenarios, the best matching speech sample may be identified and the similarity indication for the microphone signal may be determined with respect to this speech sample. The similarity indication may provide an indication of a similarity of the microphone signal (or part thereof) to the non-reverberant speech sample of the set of non-reverberant speech samples for which the highest similarity is found.

The similarity indication for a given speech signal sample may reflect the likelihood that the microphone signal resulted from a speech utterance corresponding to the speech sample.

In accordance with an optional feature of the invention, the speech samples of the set of non-reverberating speech samples are represented by parameters for a non-reverberating speech model.

This may provide efficient yet reliable and/or accurate operation. The approach may in many embodiments reduce the computational and/or memory resource requirements.

The comparator may in some embodiments evaluate the model for the different sets of parameters and compare the resulting signals to the microphone signal(s). For example, frequency representations of the microphone signals and the speech samples may be compared.

In some embodiments, model parameters for the speech model may be generated from the microphone signal, i.e. the model parameters which would result in a speech sample matching the microphone signal may be determined. These model parameters may then be compared to the parameters of the set of non-reverberant speech samples.

The non-reverberating speech model may specifically be a Linear Prediction model, such as a CELP (Code-Excited Linear Prediction) model.

In accordance with an optional feature of the invention, the comparator is arranged to determine a first reference property for a first speech sample of the set of non-reverberating speech samples from a speech sample signal generated by evaluating the non-reverberating speech model using the parameters for the first speech sample, and to determine the similarity indication for a first microphone signal of the plurality of microphone signals in response to a comparison of the property derived from the first microphone signal and the first reference property.

This may provide advantageous operation in many scenarios. The similarity indication for the first microphone signal may be determined by comparing a property determined for the first microphone signal to reference properties determined for each of the non-reverberant speech samples, the reference properties being determined from a signal representation generated by evaluating the model. Thus, the comparator may compare a property of the microphone signal to a property of the signal samples resulting from evaluating the non-reverberating speech model using the stored parameters for the non-reverberant speech samples.

In accordance with an optional feature of the invention, the comparator is arranged to decompose a first microphone signal of the plurality of microphone signals into a set of basis signal vectors; and to determine the similarity indication in response to a property of the set of basis signal vectors.

This may provide advantageous operation in many scenarios. The approach may allow reduced complexity and/or resource usage in many scenarios. The reference property may be related to a set of basis vectors in an appropriate feature domain, from which a non-reverberant feature vector can be generated as a weighted sum of basis vectors. This set can be designed such that a weighted sum with only a few basis vectors is sufficient to accurately describe the non-reverberant feature vector, i.e., the set of basis vectors provides a sparse representation for non-reverberant speech. The reference property may be the number of basis vectors that appear in the weighted sum. Using a set of basis vectors that has been designed for non-reverberant speech to describe a reverberant speech feature vector will result in a less-sparse decomposition. The property may be the number of basis vectors that receive a non-zero weight (or a weight above a given threshold) when used to describe a feature vector extracted from the microphone signal. The similarity indication may indicate an increasing similarity to non-reverberant speech for a reducing number of basic signal vectors.

In accordance with an optional feature of the invention, the comparator is arranged to determine speech similarity indications for each segment of a plurality of segments of the speech signal, and the generator is arranged to determine combination parameters for the combining for each segment.

The apparatus may utilize segmented processing. The combination may be constant for each segment but may be varied from one segment to the next. For example, the speech signal may be generated by selecting one microphone signal in each segment. The combination parameters may for example be combination weights for the microphone signal or may e.g. be a selection of a subset of microphone signals to include in the combination. The approach may provide improved performance and/or facilitated operation.

In accordance with an optional feature of the invention, the generator is arranged to determine combination parameters for one segment in response to similarity indications of at least one previous segment.

This may provide improved performance in many scenarios. For example, it may provide a better adaptation to slow changes, and may reduce disruptions in the generated speech signal.

In some embodiments, the combination parameters may be determined only based on segments containing speech and not on segments during quiet periods or pauses.

In some embodiments, the generator is arranged to determine combination parameters for a first segment in response to a user motion model.

In accordance with an optional feature of the invention, the generator is arranged to select a subset of the microphone signals to combine in response to the similarity indications.

This may allow improved and/or facilitated operation in many embodiments. The combining may specifically be selection combining. The generator may specifically select only microphone signals for which the similarity indication meets an absolute or relative criterion.

In some embodiments, the subset of microphone signals comprise only one microphone signal.

In accordance with an optional feature of the invention, the generator is arranged to generate the speech signal as a weighted combination of the microphone signals, a weight for a first of the microphone signals depending on the similarity indication for the microphone signal.

This may allow improved and/or facilitated operation in many embodiments.

According to an aspect of the invention there is provided a method of generating a speech signal, the method comprising: receiving microphone signals from a plurality of microphones; for each microphone signal, determining a speech similarity indication indicative of a similarity between the microphone signal and non-reverberant speech, the similarity indication being determined in response to a comparison of at least one property derived from the microphone signal to at least one reference property for non-reverberant speech; and generating the speech signal by combining the microphone signals in response to the similarity indications.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to the capture of speech in order to generate a speech signal for telecommunication. However, it will be appreciated that the invention is not limited to this application but may be applied to many other services and applications.

Figure 1:
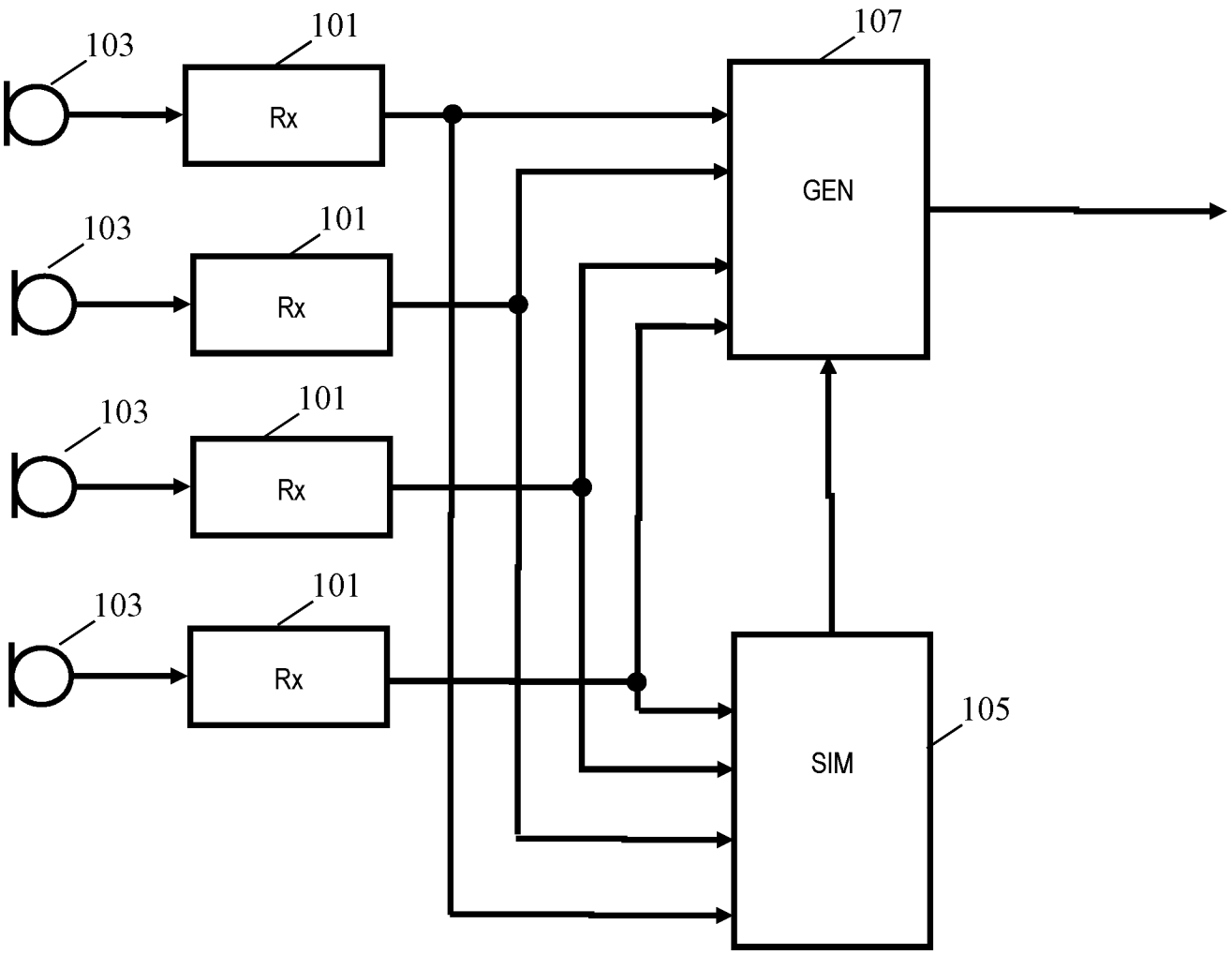
FIG. 1 is an illustration of a speech capture apparatus in accordance with some embodiments of the invention.

FIG. 1 illustrates an example of elements of a speech capture apparatus in accordance with some embodiments of the invention.

In the example, the speech capture apparatus comprises a plurality of microphone receivers 101 which are coupled to a plurality of microphones 103 (which may be part of the apparatus or may be external to the apparatus).

The set of microphone receivers 101 thus receive a set of microphone signals from the microphones 103. In the example, the microphones 103 are distributed around a room at various and unknown positions. Thus, different microphones may pick up sound from different areas, may pick up the same sound with different characteristics, or may indeed pick up the same sound with similar characteristics if they are close to each other. The relationship between the microphones 103 and between the microphones 103 and different sound sources are typically not known by the system.

The speech capture apparatus is arranged to generate a speech signal from the microphone signals. Specifically, the system is arranged to process the microphone signals to extract a speech signal from the audio captured by the microphones 103. The system is arranged to combine the microphone signals depending on how closely each of them corresponds to a non-reverberant speech signal thereby providing a combined signal which is most likely to correspond to such a signal. The combination may specifically be a selection combining wherein the apparatus selects the microphone signal most closely resembling a non-reverberant speech signal. The generation of the speech signal may be independent of the specific position of the individual microphones and does not rely on any knowledge of the position of the microphones 103 or of any speakers. Rather, the microphones 103 may for example be randomly distributed around a room, and the system may automatically adapt to e.g. predominantly use the signal from the closest microphone to any given speaker. This adaptation may happen automatically and the specific approach for identifying such a closest microphone 103 (as will be described in the following) will result in a particularly suitable speech signal in most scenarios.

In the speech capture apparatus of FIG. 1 the microphone receivers 103 are coupled to a comparator or similarity processor 105 which is fed the microphone signals.

For each microphone signal, the similarity processor 105 determines a speech similarity indication (henceforth just referred to as a similarity indication) which is indicative of a similarity between the microphone signal and non-reverberant speech. The similarity processor 105 specifically determines the similarity indication in response to a comparison of at least one property derived from the microphone signal to at least one reference property for non-reverberant speech. The reference property may in some embodiments be a single scalar value and in other embodiments may be complex set of values or functions. The reference property may in some embodiments be derived from specific non-reverberant speech signals, and may in other embodiments be a generic characteristic associated with non-reverberant speech. The reference property and/or property derived from the microphone signal may for example be a spectrum, a power spectral density characteristic, a number of non-zero basis vectors etc. In some embodiments, the properties may be signals, and specifically the property derived from the microphone signal may be the microphone signal itself. Similarly, the reference property may be a non-reverberant speech signal.

Specifically, the similarity processor 105 may be arranged to generate a similarity indication for each of the microphone signals where the similarity indication is indicative of a similarity of the microphone signal to a speech sample from a set of non-reverberant speech samples. Thus, in the example, the similarity processor 105 comprises a memory storing a (typically large) number of speech samples where each speech sample corresponds to speech in a non-reverberant, and specifically substantially anechoic, room. As an example, the similarity processor 105 may compare each microphone signal to each of the speech samples and for each speech sample determine a measure of the difference between the stored speech sample and the microphone signal. The difference measures for the speech samples may then be compared and the measure indicative of the smallest difference may be selected. This measure may then be used to generate (or as) the similarity indication for the specific microphone signal. The process is repeated for all microphone signals resulting in a set of similarity indications. Thus, the set of similarity indications may indicate how much each of the microphone signals resembles non-reverberant speech.

In many embodiments and scenarios, such a signal sample domain comparison may not be sufficiently reliable due to uncertainty relating to variations in microphone levels, noise etc. Therefore, in many embodiments, the comparator may be arranged to determine the similarity indication in response to a comparison performed in the feature domain. Thus, in many embodiments, the comparator may be arranged to determine some features/parameters from the microphone signal and compare these to stored features/parameters for non-reverberant speech. For example, as will be described in more detail later, the comparison may be based on parameters for a speech model, such as coefficients for a linear prediction model. Corresponding parameters may then be determined for the microphone signal and compared to stored parameters corresponding to various utterances in an anechoic environment.

Non-reverberant speech is typically achieved when the acoustic transfer function from a speaker is dominated by the direct path and with the reflected and reverberant parts being substantially attenuated. This also typically corresponds to situations where the speaker is relatively close to the microphone and may correspond most closely to a traditional arrangement where the microphone is positioned close to a speaker's mouth. Non-reverberant speech may also often be considered the most intelligible, and indeed is that which most closely corresponds to the actual speech source.

The apparatus of FIG. 1 utilizes an approach that allows the speech reverberation characteristic for the individual microphones to be assessed such that this can be taken into consideration. Indeed, the Inventor has realized not only that considerations of speech reverberation characteristics for individual microphone signals when generating a speech signal may improve quality substantially, but also how this can feasibly be achieved without requiring dedicated test signals and measurements. Indeed, the Inventor has realized that by comparing a property of the individual microphone signals with a reference property associated with non-reverberant speech, and specifically with sets of non-reverberant speech samples, it is possible to determine suitable parameters for combining the microphone signals to generate an improved speech signal. In particular, the approach allows the speech signal to be generated without necessitating any dedicated test signals, test measurements, or indeed a priori knowledge of the speech. Indeed, the system may be designed to operate with any speech and does not require e.g. specific test words or sentences to be spoken by the speaker.

In the system of FIG. 1, the similarity processor 105 is coupled to a generator 107 which is fed the similarity indications. The generator 107 is further coupled to the microphone receivers 101 from which it receives the microphone signals. The generator 107 is arranged to generate an output speech signal by combining the microphone signals in response to the similarity indications.

As a low complexity example, the generator 107 may implement a selection combiner wherein e.g. a single microphone signal is selected from the plurality of microphone signals. Specifically, the generator 107 may select the microphone signal which most closely matches a non-reverberant speech sample. The speech signal is then generated from this microphone signal which is typically most likely to be the cleanest and clearest capture of the speech. Specifically, it is likely to be the one that much closely corresponds to the speech uttered by the listener. Typically, it will also correspond to the microphone which is closest to the speaker.

In some embodiments, the speech signal may be communicated to a remote user, e.g. via a telephone network, a wireless connection, the Internet or any other communication network or link. The communication of the speech signal may typically include a speech encoding as well as potentially other processing.

The apparatus of FIG. 1 may thus automatically adapt to the positions of the speaker and microphones, as well as to the acoustic environment characteristics, in order to generate a speech signal that most closely corresponds to the original speech signal. Specifically, the generated speech signal will tend to have reduced reverberation and noise, and will accordingly sound less distorted, cleaner, and more intelligible.

It will be appreciated that the processing may include various other processing, including typically amplification, filtering, conversion between the time domain and the frequency domain, etc. as is typically done in audio and speech processing. For example, the microphone signals may often be amplified and filtered prior to being combined and/or used to generate the similarity indications. Similarly the generator 107 may include filtering, amplification etc. as part of the combining and/or generation of the speech signal.

In many embodiments, the speech capture apparatus may use segmented processing. Thus, the processing may be performed in short time intervals, such as in segments of less than 100 msec duration, and often in around 20 msec segments.

Thus, in some embodiments, a similarity indication may be generated for each microphone signal in a given segment. For example, a microphone signal segment of, say, 50 msec duration may be generated for each of the microphone signals. The segment may then be compared to the set of non-reverberant speech samples which itself may be comprised of speech segment samples. The similarity indications may be determined for this 50 msec segment, and the generator 107 may proceed to generate a speech signal segment for the 50 msec interval based on the microphone signal segments and the similarity indications for the segment/interval. Thus, the combination may be updated for each segment, e.g. by in each segment selecting the microphone signal which has the highest similarity to a speech segment sample of the non-reverberant speech samples. This may provide a particularly efficient processing and operation, and may allow a continuous and dynamic adaptation to the specific environment. Indeed, an adaption to dynamic movement in the speaker sound source and/or microphone positions can be achieved with low complexity. For example, if speech switches between two sources (speakers) the system may adapt to correspondingly switch between two microphones.

In some embodiments, the non-reverberant speech segment samples may have a duration which matches those of the microphone signal segments. However, in some embodiments, they may be longer. For example, each non-reverberant speech segment sample may correspond to a phoneme or specific speech sound which has a longer duration. In such embodiments, the determination of a similarity measure for each non-reverberant speech segment sample may include an alignment of the microphone signal segment to the speech segment samples. For example, a correlation value may be determined for different time offsets and the highest value may be selected as the similarity indication. This may allow a reduced number of speech segment samples to be stored.

In some examples, the combination parameters, such as a selection of a subset of microphone signals to use, or weights for a linear summation, may be determined for a time interval of the speech signal. Thus, the speech signal may be determined in segments from a combination which is based on parameters that are constant for the segment but which may vary between segments.

In some embodiments, the determination of combination parameters is independent for each time segment, i.e. the combination parameters for the time segment may be calculated based only on similarity indications that are determined for that time segment.

However, in other embodiments, the combination parameters may alternatively or additionally be determined in response to similarity indications of at least one previous segment. For example, the similarity indications may be filtered using a low pass filter that extends over several segments. This may ensure a slower adaptation which may e.g. reduce fluctuations and variations in the generated speech signal. As another example, a hysteresis effect may be applied which prevents e.g. quick ping-pong switching between two microphones positioned at roughly the same distance from a speaker.

In some embodiments, the generator 107 may be arranged to determine combination parameters for a first segment in response to a user motion model. Such an approach may be used to track the relative position of the user relative to the microphone devices 201, 203, 205. The user model need not explicitly track positions of the user or the microphone devices 201, 203, 205 but may directly track the variations of the similarity indications. For example, a state-space representation may be employed to describe a human motion model and a Kalman filter may be applied to the similarity indications of the individual segments of one microphone signal in order to track the variations of the similarity indications due to movement. The resulting output of the Kalman filter may then be used as the similarity indication for the current segment.

In many embodiments, the functionality of FIG. 1 may be implemented in a distributed fashion, and in particular the system may be spread over a plurality of devices. Specifically, each of the microphones 103 may be part of or connected to a different device, and thus the microphone receivers 101 may be comprised in different devices.

In some embodiments, the similarity processor 105 and generator 107 are implemented in a single device. For example, a number of different remote devices may transmit a microphone signal to a generator device which is arranged to generate a speech signal from the received microphone signals. This generator device may implement the functionality of the similarity processor 105 and the generator 107 as previously described.

However, in many embodiments, the functionality of the similarity processor 105 is distributed over a plurality of separate devices. Specifically, each of the devices may comprise a (sub)similarity processor 105 which is arranged to determine a similarity indication for the microphone signal of that device. The similarity indications may then be transmitted to the generator device which may determine parameters for the combination based on the received similarity indications. For example, it may simply select the microphone signal/device which has the highest similarity indication. In some embodiments, the devices may not transmit microphone signals to the generator device unless the generator device requests this. Accordingly, the generator device may transmit a request for the microphone signal to the selected device which in return provides this signal to the generator device. The generator device then proceeds to generate the output signal based on the received microphone signal. Indeed, in this example, the generator 107 may be considered to be distributed over the devices with the combination being achieved by the process of selecting and selectively transmitting the microphone signal. An advantage of such an approach is that only one (or at least a subset) of the microphone signals need to be transmitted to the generator device, and thus that a substantially reduced communication resource usage can be achieved.

As an example, the approach may use microphones of devices distributed in an area of interest in order to capture a user's speech. A typical modern living room typically has a number of devices equipped with one or more microphones and wireless transmission capabilities. Examples include cordless fixed-line phones, mobile phones, video chat-enabled televisions, tablet PCs, laptops, etc. These devices may in some embodiments be used to generate a speech signal, e.g. by automatically and adaptively selecting the speech captured by the microphone closest to the speaker. This may provide captured speech which typically will be of high quality and free from reverberation.

Indeed, generally the signal captured by a microphone will tend to be affected by reverberation, ambient noise and microphone noise with the impact depending on its location with respect to the sound source, e.g., to the user's mouth. The system may seek to select the microphone which is closest to that which would be recorded by a microphone close to the user's mouth. The generated speech signal can be applied where hands-free speech capture is desirable such as e.g., home/office telephony, tele-conferencing systems, front-end for voice control systems, etc.

Figure 2:
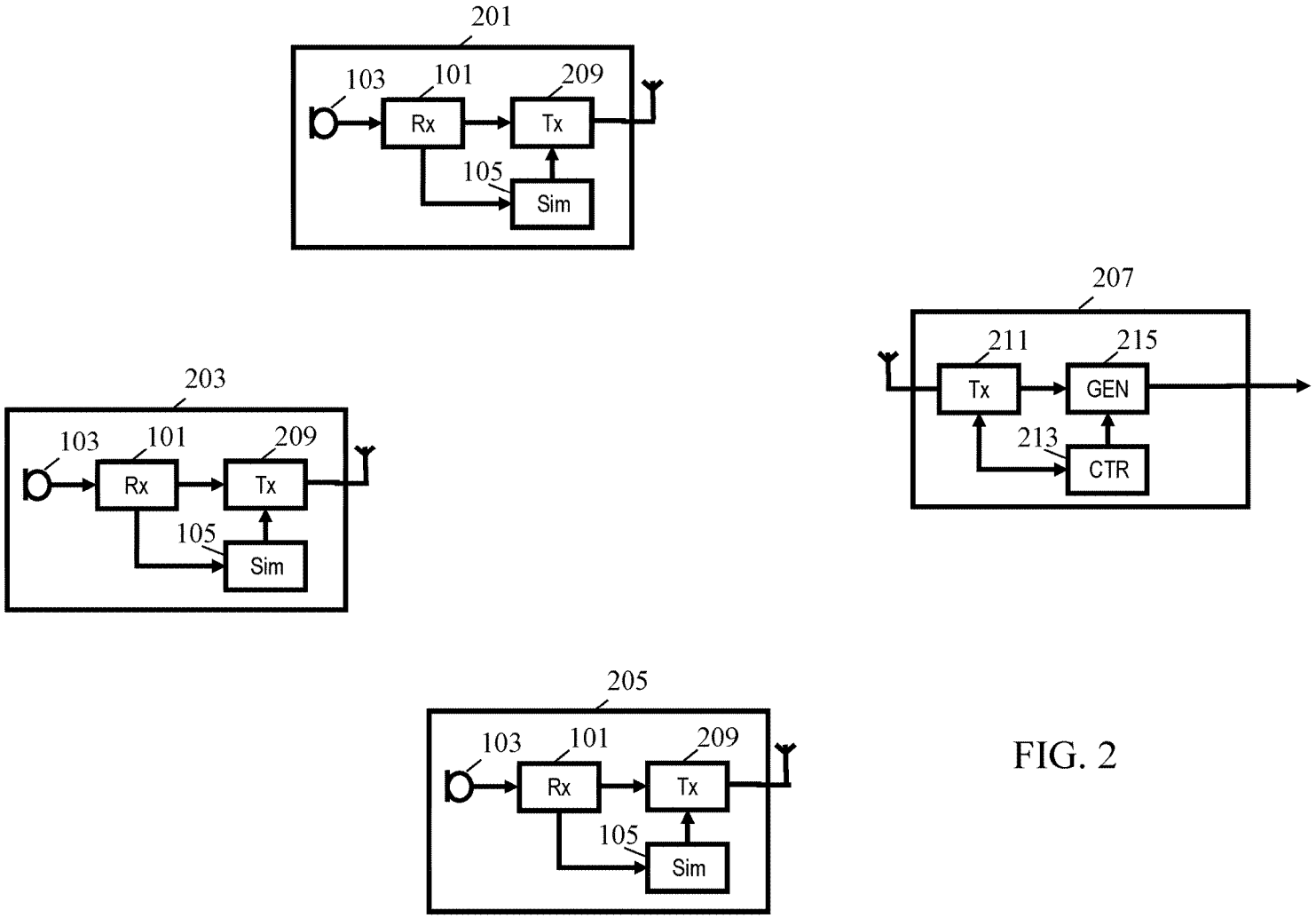
FIG. 2 is an illustration of a speech capture system in accordance with some embodiments of the invention.

In more detail FIG. 2 illustrates an example of a distributed speech generating/capturing apparatus/system. The example includes a plurality of microphone devices 201, 203, 205 as well as a generator device 207.

Each of the microphone devices 201, 203, 205 comprises a microphone receiver 101 which receives a microphone signal from a microphone 103 which in the example is part of the microphone device 201, 203, 205 but in other cases may be separate therefrom (e.g. one or more of the microphone devices 201, 203, 205 may comprise a microphone input for attaching an external microphone). The microphone receiver 101 in each microphone device 201, 203, 205 is coupled to a similarity processor 105 which determines a similarity indication for the microphone signal.

The similarity processor 105 of each microphone device 201, 203, 205 specifically performs the operation of the similarity processor 105 of FIG. 1 for the specific microphone signal of the individual microphone device 201, 203, 205. Thus, the similarity processor 105 of each of the microphone devices 201, 203, 205 specifically proceeds to compare the microphone signal to a set of non-reverberant speech samples which are locally stored in each of the devices. The similarity processor 105 may specifically compare the microphone signal to each of the non-reverberant speech samples and for each speech sample determine an indication of how similar the signals are. For example, if the similarity processor 105 includes memory for storing a local database comprising a representation of each of the phonemes of human speech, the similarity processor 105 may proceed to compare the microphone signal to each phoneme. Thus a set of indications indicating how closely the microphone signal resembles each of the phonemes that do not include any reverberation or noise is determined. The indication corresponding to the closest match is thus likely to correspond to an indication of how closely the captured audio corresponds to the sound generated by a speaker speaking that phoneme. Thus, the indication of the closest similarity is chosen as the similarity indication for the microphone signal. This similarity indication accordingly reflects how much the captured audio corresponds to noise-free and reverberation-free speech. For a microphone (and thus typically device) positioned far from the speaker the captured audio is likely to include only low relative levels of the original projected speech compared to the contribution from various reflections, reverberation and noise. However, for a microphone (and thus device) positioned close to the speaker, the captured sound is likely to comprise a significantly higher contribution from the direct acoustic path and relatively lower contributions from reflections and noise. Accordingly, the similarity indication provides a good indication of how clean and intelligible the speech of the captured audio of the individual device is.

Each of the microphone devices 201, 203, 205 furthermore comprises a wireless transceiver 209 which is coupled to the similarity processor 105 and the microphone receiver 101 of each device. The wireless transceiver 209 is specifically arranged to communicate with the generator device 207 over a wireless connection.

The generator device 207 also comprises a wireless transceiver 211 which may communicate with the microphone devices 201, 203, 205 over the wireless connection.

In many embodiments, the microphone devices 201, 203, 205 and the generator device 207 may be arranged to communicate data both directions. However, it will be appreciated that in some embodiments, only one-way communication from the microphone devices 201, 203, 205 to the generator device 207 may be applied.

In many embodiments, the devices may communicate via a wireless communication network such as a local Wi-Fi communication network. Thus, the wireless transceiver 207 of the microphone devices 201, 203, 205 may specifically be arranged to communicate with other devices (and specifically with the generator device 207) via Wi-Fi communications. However, it will be appreciated that in other embodiments other communication methods may be used including for example communication over e.g. a wired or wireless Local Area Network, Wide Area Network, the Internet, Bluetooth™ communication links etc.

In some embodiments, each of the microphone devices 201, 203, 205 may always transmit the similarity indications and the microphone signals to the generator device 207. It will be appreciated that the skilled person is well aware of how data, such as parameter data and audio data, may be communicated between devices. Specifically, the skilled person will be well aware of how audio signal transmission may include encoding, compression, error correction etc.

In such embodiments, the generator device 207 may receive the microphone signals and the similarity indications from all the microphone devices 201, 203, 205. It may then proceed to combine the microphone signals based on the similarity indications in order to generate the speech signal.

Specifically, the wireless transceiver 211 of the generator device 207 is coupled to a controller 213 and a speech signal generator 215. The controller 213 is fed the similarity indications from the wireless transceiver 211 and in response to these it determines a set of combination parameters which control how the speech signal is generated from the microphone signals. The controller 213 is coupled to the speech signal generator 215 which is fed the combination parameters. In addition, the speech signal generator 215 is fed the microphone signals from the wireless transceiver 211, and it may accordingly proceed to generate the speech signal based on the combination parameters.

As a specific example, the controller 213 may compare the received similarity indications and identify the one indicating the highest degree of similarity. An indication of the corresponding device/microphone signal may then be passed to the speech signal generator 215 which can proceed to select the microphone signal from this device. The speech signal is then generated from this microphone signal.

As another example, in some embodiments, the speech signal generator 215 may proceed to generate the output speech signal as a weighted combination of the received microphone signals. For example, a weighted summation of the received microphone signals may be applied where the weights for each individual signal is generated from the similarity indications. For example, the similarity indications may directly be provided as a scalar value within a given range, and the individual weights may directly be proportional to the scalar value (with e.g. a proportionality factor ensuring that the signal level or accumulated weight value is constant).

Such an approach may be particularly attractive in scenarios where the available communication bandwidth is not a constraint. Thus, instead of selecting a device closest to the speaker, a weight may be assigned to each device/microphone signal, and the microphone signals from the various microphones may be combined as a weighted sum. Such an approach may provide robustness and mitigate the impact of an erroneous selection in highly reverberant or noisy environments.

It will also be appreciated that the combination approaches can be combined. For example, rather than using a pure selection combining, the controller 213 may select a subset of microphone signals (such as e.g. the microphone signals for which the similarity indication exceeds a threshold) and then combine the microphone signals of the subset using weights that are dependent on the similarity indications.

It will also be appreciated that in some embodiments, the combination may include an alignment of the different signals. For example, time delays may be introduced to ensure that the received speech signals add coherently for a given speaker.

In many embodiments, the microphone signals are not transmitted to the generator device 207 from all microphone devices 201, 203, 205 but only from the microphone devices 201, 203, 205 from which the speech signal will be generated.

For example, the microphone devices 201, 203, 205 may first transmit the similarity indications to the generator device 207 with the controller 213 evaluating the similarity indications to select a subset of microphone signals. For example, the controller 213 may select the microphone signal from the microphone device 201, 203, 205 which has sent the similarity indication that indicates the highest similarity. The controller 213 may then transmit a request message to the selected microphone device 201, 203, 205 using the wireless transceiver 211. The microphone devices 201, 203, 205 may be arranged to only transmit data to the generator device 207 when a request message is received, i.e. the microphone signal is only transmitted to the generator device 207 when it is included in the selected subset. Thus, in the example where only a single microphone signal is selected, only one of the microphone devices 201, 203, 205 transmits a microphone signal. Such an approach may substantially reduce the communication resource usage as well as reduce e.g. power consumption of the individual devices. It may also substantially reduce the complexity of the generator device 207 as this only needs to deal with e.g. one microphone signal at a time. In the example, the selection combining functionality used to generate the speech signal is thus distributed over the devices.

Different approaches for determining the similarity indications may be used in different embodiments, and specifically the stored representations of the non-reverberant speech samples may be different in different embodiments, and may be used differently in different embodiments.

In some embodiments, the stored non-reverberant speech samples are represented by parameters for a non-reverberating speech model. Thus, rather than storing e.g. a sampled time or frequency domain representation of the signal, the set of non-reverberant speech samples may comprise a set of parameters for each sample which may allow the sample to be generated.

For example, the non-reverberating speech model may be a linear prediction model, such as specifically a CELP (Code Excited Linear Prediction) model. In such a scenario, each speech sample of the non-reverberant speech samples may be represented by a codebook entry which specifies an excitation signal that may be used to excite a synthesis filter (which may also be represented by the stored parameters).

Such an approach may substantially reduce the storage requirements for the set of non-reverberant speech samples and this may be particularly important for distributed implementations where the determination of the similarity indications is performed locally in the individual devices. Furthermore, by using a speech model which directly synthesizes speech from a speech source (without consideration of the acoustic environment), a good representation of non-reverberant, anechoic speech is achieved.

In some embodiments, the comparison of a microphone signal to a specific speech sample may be performed by evaluating the speech model for the specific set of stored speech model parameters for that signal. Thus, a representation of the speech signal which will be synthesized by the speech model for that set of parameters may be derived. The resulting representation may then be compared to the microphone signal and a measure of the difference between these may be calculated. The comparison may for example be performed in the time domain or in the frequency domain, and may be a stochastic comparison. For example, the similarity indication for one microphone signal and one speech sample may be determined to reflect the likelihood that the captured microphone signal resulted from a sound source radiating the speech signal resulting from a synthesis by the speech model. The speech sample resulting in the highest likelihood may then be selected, and the similarity indication for the microphone signal may be determined as the highest likelihood.

In the following, a detailed example of a possible approach for determining similarity indications based on a LP speech model will be provided.

In the example K microphones may be distributed in an area. The observed microphone signals may be modeled as $$y_k(n)=h_k(n)*s(n)+w_k(n),$$

where s(n) is the speech signal at the user's mouth, $h_k(n)$ is the acoustic transfer function between the location corresponding to the user's mouth and the location of the $k^{th}$ microphone, and $w_k(n)$ is the noise signal, including both ambient and microphone self-noise. Assuming that the speech and noise signals are independent, an equivalent representation in the frequency domain in terms of the power spectral densities (PSDs) of the corresponding signals is given by:

$$P_{y_k}(n)=P_{x_k}(n)+P_{w_k}(n), 1\leq k\leq K.$$

In an anechoic environment, the impulse response $h_k(n)$ corresponds to a pure delay, corresponding to the time taken for the signal to propagate from the point of generation to the microphone at the speed of sound. Consequently, the PSD of the signal $x_k(n)$ is identical to that of s(n). In a reverberant environment, $h_k(n)$ models not only the direct path of the signal from the sound source to the microphone but also signals arriving at the microphone as a result of being reflected by walls, ceiling, furniture, etc. Each reflection delays and attenuates the signal.

Figure 3:
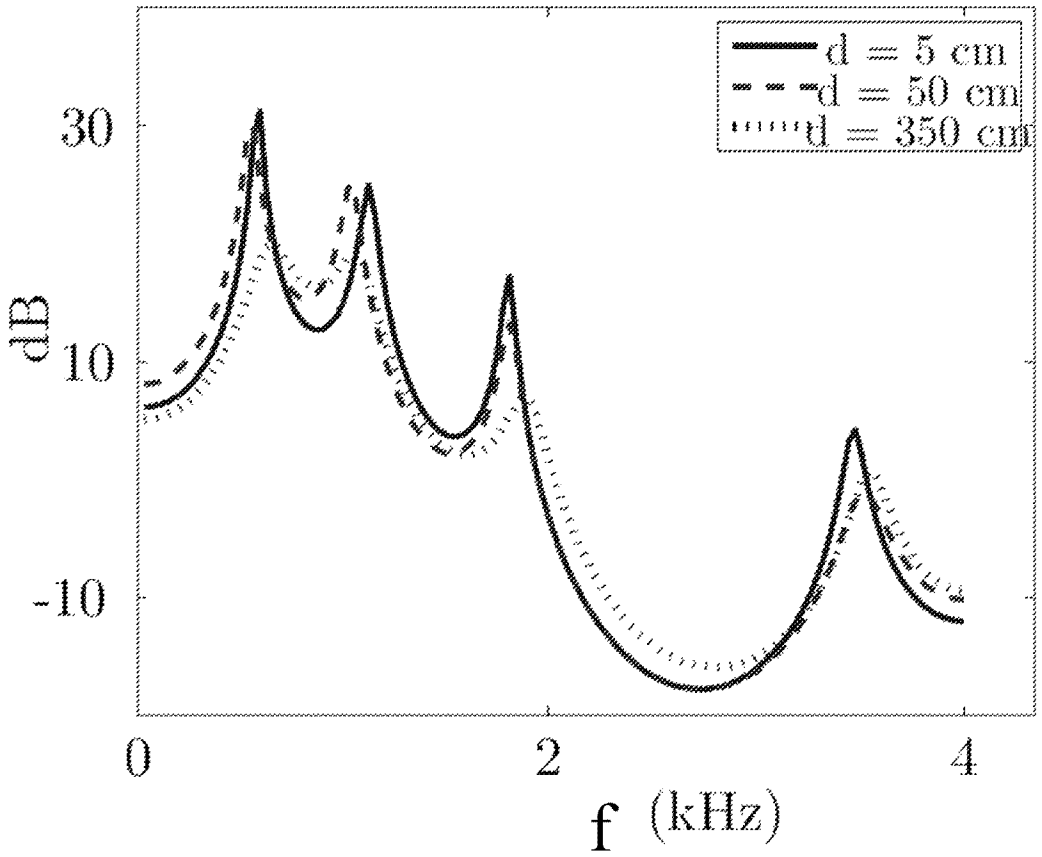
FIG. 3 illustrates an example of spectral envelopes corresponding to a segment of speech recorded at three different distances in a reverberant room.

The PSD of $x_k(n)$ in this case could vary significantly from that of s(n), depending on the level of reverberation. FIG. 3 illustrates an example of spectral envelopes corresponding to a 32 ms segment of speech recorded at three different distances in a reverberant room, with a T60 of 0.8 seconds. Clearly, the spectral envelopes of speech recorded at 5 cm and 50 cm distance from the speaker are relatively close whereas the envelope at 350 cm is significantly different.

When the signal of interest is speech, as in hands-free communication applications, the PSD may be modeled using a codebook trained offline using a large dataset. For example, the codebook may contain linear prediction (LP) coefficients, which model the spectral envelope.

The training set typically consists of LP vectors extracted from short segments (20-30 ms) of a large set of phonetically balanced speech data. Such codebooks have been successfully employed in speech coding and enhancement. A codebook trained on speech recorded using a microphone located close to the user's mouth can then be used as a reference measure of how reverberant the signal received at a particular microphone is.

The spectral envelope corresponding to a short-time segment of a microphone signal captured at a microphone close to the speaker will typically find a better match in the codebook than that captured at a microphone further away (and thus relatively more affected by reverberation and noise). This observation can then be used e.g. to select an appropriate microphone signal in a given scenario.

Assuming that the noise is Gaussian, and given a vector of LP coefficients a, we have at the $k^{th}$ microphone (ref. e.g. S. Srinivasan, J. Samuelsson, and W. B. Kleijn, "Codebook driven short-term predictor parameter estimation for speech enhancement," IEEE Trans. Speech, Audio and Language Processing, vol. 14, no. 1, pp. 163-176, January 2006):

$$p(y_k;a)=\frac{1}{(2\pi)^{N/2}|R_x+R_w^k|^{1/2}}\exp\left(-\frac{1}{2}y_k^T(R_x+R_w^k)^{-1}y_k\right),$$

where $y_k=[y_k(0), y_k(1), \ldots, y_k(N-1)]^T$, $a=[1, a_1, \ldots, a_M]^T$ is the given vector of LP coefficients, M is the LP model order, N is the number of samples in a short-time segment, $R_w^k$ is the auto-correlation matrix of the noise signal at the $k^{th}$ microphone, and $R_x=g(A^TA)^{-1}$, where A is the N×N lower triangular Toeplitz matrix with $[1, a_1, a_2, \ldots, a_M, :0, \ldots, 0]^T$ as the first column, and g is a gain term to compensate for the level difference between the normalized codebook spectra and the observed spectra.

If we let the frame length approach infinity, the covariance matrices can be described as circulant and are diagonalized by the Fourier transform. The logarithm of the likelihood in the above equation, corresponding to the $i^{th}$ speech codebook vector $a^i$, can then be written using frequency domain quantities as (refer e.g. U. Grenander and G. Szego, "Toeplitz forms and their applications", 2nd ed. New York: Chelsea, 1984):

$$L_k^i = \ln p(y_k; a^i) = C - \frac{1}{2}\int_0^{2\pi} \frac{p_{y_k}(\omega)}{\frac{g^i}{|A^i(\omega)|^2} + P_{w_k}(\omega)} + \ln\left(\frac{g^i}{|A^i(\omega)|^2} + P_{w_k}(\omega)\right) d\omega,$$

where C captures the signal-independent constant terms and $A^i(\omega)$ is the spectrum of the $i^{th}$ vector from the codebook, given by $$A^i(\omega) = \sum_{m=0}^{M} a_m^i e^{-j\omega m}.$$

For a given codebook vector $a^i$, the gain compensation term can be obtained as:

$$g^i = \underset{g}{\operatorname{argmin}} \int_0^{2\pi} \left[P_{y_k}(\omega) - \left(\frac{g}{|A^i(\omega)|^2} + P_{w_k}(\omega)\right)\right]^2 d\omega = \frac{\int_0^{2\pi} \max(P_{y_k}(\omega) - P_{w_k}(\omega), 0) d\omega}{\int_0^{2\pi} \frac{1}{|A^i(\omega)|^2} d\omega},$$

where negative values in the numerator that may arise due to erroneous estimates of the noise PSD $P_{w_k}(\omega)$ are set to zero. It should be noted that all the quantities in this equation are available. The noisy PSD $P_{y_k}(\omega)$ and the noise PSD $P_{w_k}(\omega)$ can be estimated from the microphone signal, and $A^i(\omega)$ is specified by the $i^{th}$ codebook vector. For each sensor, a maximum likelihood value is computed over all codebook vectors, i.e., $$L^*_k = \max_{1 \le i \le I} L_k^i, 1 \le k \le K,$$

where I is the number of vectors in the speech codebook. This maximum likelihood value is then used as the similarity indication for the specific microphone signal.

Finally, the microphone for the largest value of the maximum likelihood value t is determined as the microphone closest to the speaker, i.e. the microphone signal resulting in the largest maximum likelihood value is determined:

$$k^* = \max_{1 \le k \le K} L^*_k.$$

Experiments been performed for this specific example. A codebook of speech LP coefficients were generated using training data from the Wall Street Journal (WSJ) speech database (CSR-II (WSJ1) Complete," Linguistic Data Consortium, Philadelphia, 1994). 180 distinct training utterances of duration around 5 sec each from 50 different speakers, 25 male and 25 female, were used as the training data. Using the training utterances, around 55000 LP coefficients were extracted from Hann-windowed segments of size 256 samples, with a 50 percent overlap at a sampling frequency of 8 kHz. The codebooks were trained using LBG algorithm (Y. Linde, A. Buzo, and R. M. Gray, "An algorithm for vector quantizer design," IEEE Trans. Communications, vol. COM-28, no. 1, pp. 84-95, January 1980.) with the Itakura-Saito distortion (S. R. Quackenbush, T. P. Barnwell, and M. A. Clements, Objective "Measures of Speech Quality". New Jersey: Prentice-Hall, 1988.) as the error criterion. The codebook size was fixed at 256 entries. A three microphone setup was considered and the microphones were located at 50 cm, 150 cm and 350 cm from the speaker in a reverberant room (T60=800 ms). The impulse response between the location of the speaker and each of the three microphones was recorded and then convolved with a dry speech signal to obtain the microphone data. The microphone noise at each microphone was 40 dB below the speech level.

Figure 4:
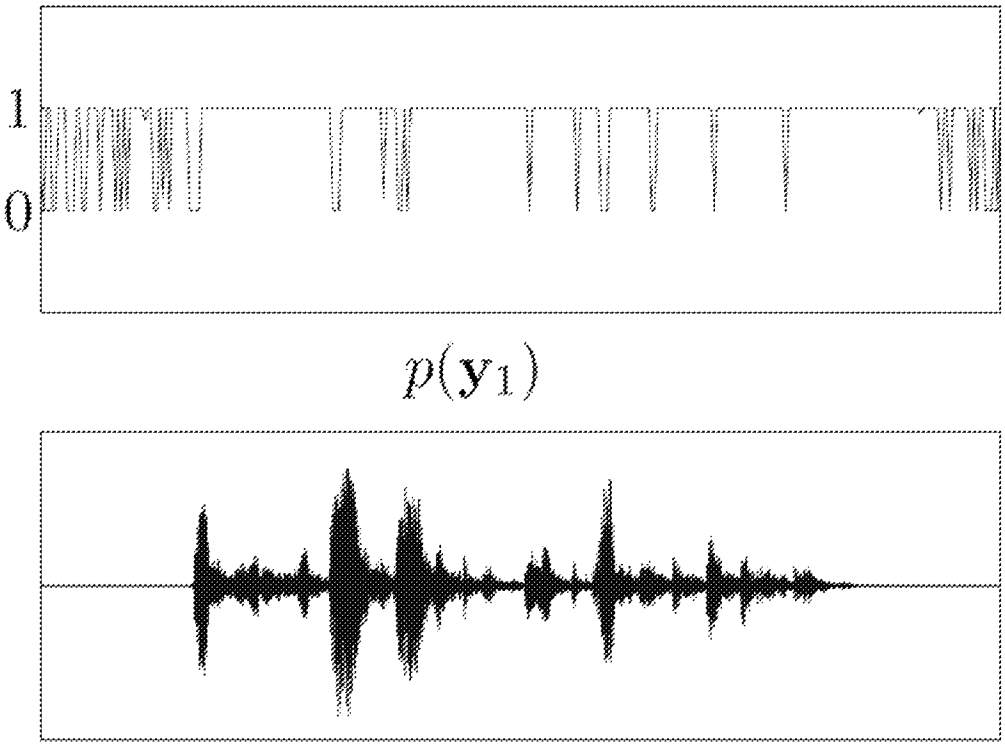
FIG. 4 illustrates an example of a likelihood of a microphone being the closest microphone to a speaker determined in accordance with some embodiments of the invention.

FIG. 4 shows the likelihood $p(y_1)$ for a microphone located 50 cm away from the speaker. In the speech dominated regions, this microphone (which is located closest to the speaker) receives a value close to unity and the likelihood values at the other two microphones are close to zero. The closest microphone is thus correctly identified.

A particular advantage of the approach is that it inherently compensates for signal level differences between the different microphones.

It should be noted that the approach selects the appropriate microphone during speech activity. However, during non-speech segments (such as e.g. pauses in the speech or when the speaker changes) will not allow such a selection to be determined. However, this may simply be addressed by the system including a speech activity detector (such as a simple level detector) to identify the non-speech periods. During these periods, the system may simply proceed using the combination parameters determined for the last segment which included a speech component.

In the previous embodiments, the similarity indications have been generated by comparing properties of the microphone signals to properties of non-reverberant speech samples, and specifically comparing properties of the microphone signals to properties of speech signals that result from evaluating a speech model using the stored parameters.

However, in other embodiments, a set of properties may be derived by analyzing the microphone signals and these properties may then be compared to expected values for non-reverberant speech. Thus, the comparison may be performed in the parameter or property domain without consideration of specific non-reverberant speech samples.

Specifically, the similarity processor 105 may be arranged to decompose the microphone signals using a set of basis signal vectors. Such a decomposition may specifically use a sparse overcomplete dictionary that contains signal prototypes, also called atoms. A signal is then described as a linear combination of a subset of the dictionary. Thus, each atom may in this case correspond to a basis signal vector.

In such embodiments, the property derived from the microphone signals and used in the comparison may be the number of basis signal vectors, and specifically the number of dictionary atoms, that are needed to represent the signal in an appropriate feature domain.

The property may then be compared to one or more expected properties for non-reverberant speech. For example, in many embodiments, the values for the set of basis vectors may be compared to samples of values for sets of basis vector corresponding to specific non-reverberant speech samples.

However, in many embodiments a simpler approach may be used. Specifically, if the dictionary is trained on non-reverberant speech, then a microphone signal that contains less reverberant speech can be described using a relatively low number of dictionary atoms. As the signal is increasingly exposed to reverberation and noise, an increasing number of atoms will be required, i.e. the energy will tend to be spread more equally over more basis vectors.

Accordingly, in many embodiments, the distribution of the energy across the basis vectors may be evaluated and used to determine the similarity indication. The more the distribution is spread, the lower is the similarity indication.

As a specific example, when comparing signals from two microphones, the one that can be described using fewer dictionary atoms is more similar to non-reverberant speech (where the dictionary has been trained on non-reverberant speech).

As a specific example, the number of basis vectors for which the value (specifically the weight of each basis vector in a combination of basis vectors approximating the signal) exceeds a given threshold may be used to determine the similarity indication. Indeed, the number of basis vectors which exceed the threshold may simply be calculated and directly used as the similarity indication for a given microphone signal, with an increasing number of basis vectors indicating a reduced similarity. Thus, the property derived from the microphone signal may be the number of basis vector values that exceed a threshold, and this may be compared to a reference property for non-reverberant speech of zero or one basis vectors having values above the threshold. Thus, the higher the number of basis vectors the lower will the similarity indication be.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc. do not preclude a plurality. Reference signs in the claims are provided merely as a clarifying example shall not be construed as limiting the scope of the claims in any way.

The invention claimed is:

1. An apparatus for generating a speech signal, the apparatus comprising:

microphone receivers for receiving a plurality of microphone signals from a plurality of microphones;

a processor configured to select a microphone receiver from the microphone receivers based on how much a microphone signal of the microphone signals reaches the selected microphone receiver via a direct path and how much reaches the microphone receiver via reverberant paths by determining, for each microphone signal, a speech similarity indication indicative of a similarity between the microphone signal and a non-reverberant speech signal, the processor being configured to determine the speech similarity indication in response to a comparison of at least one property derived from the microphone signal to at least one reference property for the non-reverberant speech signal; and a generator configured to generate the speech signal by combining the microphone signals in response to the speech similarity indications, wherein the processor is further configured to determine the speech similarity indication for a first microphone signal in response to a comparison of at least one property derived from the first microphone signal to reference properties for speech samples of a set of non-reverberant speech samples, and wherein the non-reverberant speech signal is a speech signal of one other than a user of the apparatus.

2. The apparatus of claim 1 comprising a plurality of separate devices, each device comprising a microphone receiver for receiving at least one microphone signal of the plurality of microphone signals.

3. The apparatus of claim 2 wherein at least a first device of the plurality of separate devices comprises a local comparator for determining a first speech similarity indication for the at least one microphone signal of the first device.

4. The apparatus of claim 3 wherein the generator is implemented in a generator device separate from at least the first device; and wherein the first device comprises a transmitter for transmitting the first speech similarity indication to the generator device.

5. The apparatus of claim 4 wherein the generator device is configured to receive speech similarity indications from each of the plurality of separate devices, and wherein the generator is configured to generate the speech signal using a subset of microphone signals from the plurality of separate devices, the subset being determined in response to the speech similarity indications received from the plurality of separate devices.

6. The apparatus of claim 5 wherein at least one device of the plurality of separate devices is configured to transmit the at least one microphone signal of the at least one device to the generator device only if the at least one microphone signal of the at least one device is comprised in the subset of microphone signals.

7. The apparatus of claim 5 wherein the generator device comprises a selector configured to determine the subset of microphone signals, and a transmitter for transmitting an indication of the subset to at least one of the plurality of separate devices.

8. The apparatus of claim 1 wherein the speech samples of the set of non-reverberating speech samples are represented by parameters for a non-reverberating speech model.

9. The apparatus of claim 8 wherein the processor is configured to determine a first reference property for a first speech sample of the set of non-reverberating speech samples from a speech sample signal generated by evaluating the non-reverberating speech model using the parameters for the first speech sample, and to determine the speech similarity indication for a first microphone signal of the plurality of microphone signals in response to a comparison of the property derived from the first microphone signal and the first reference property.

10. The apparatus of claim 1 wherein the processor is configured to decompose the first microphone signal of the plurality of microphone signals into a set of basis signal vectors; and to determine the speech similarity indication for the first microphone signal in response to a property of the set of basis signal vectors.

11. The apparatus of claim 1 wherein the processor is configured to determine the speech similarity indications for each segment of a plurality of segments of the speech signal, and the generator is configured to determine combination parameters for each segment to control how the speech signal is generated from the microphone signals.

12. The apparatus of claim 9 wherein the generator is configured to determine combination parameters for one segment in response to similarity indications of at least one previous segment.

13. The apparatus of claim 1 wherein the generator is configured to select a subset of the microphone signals to combine in response to the similarity indications.

14. A method of generating a speech signal, the method comprising acts of:

receiving microphone signals from a plurality of microphones;

selecting a microphone from the plurality of microphones based on how much a microphone signal of the microphone signals reaches the selected microphone via a direct path and how much reaches the microphone via reverberant paths, by determining, for each microphone signal, a speech similarity indication indicative of a similarity between the microphone signal and a non-reverberant speech signal, the speech similarity indication being determined in response to a comparison of at least one property derived from the microphone signal to at least one reference property for non-reverberant speech signal; and generating the speech signal by combining the microphone signals in response to the speech similarity indications, determining the speech similarity indication for a first microphone signal in response to a comparison of at least one property derived from the first microphone signal to reference properties for speech samples of a set of non-reverberant speech samples, and wherein the non-reverberant speech signal is a speech signal of one other than a user of the apparatus.

15. The method of claim 14, wherein the identifying act includes acts of:

decomposing a first microphone signal of the plurality of microphone signals into a set of basis signal vectors; and determining the speech similarity indication for the first microphone signal in response to a property of the set of basis signal vectors.

* * * * *